United States Patent [19]

Horkey

[11] Patent Number: 4,844,051

[45] Date of Patent: Jul. 4, 1989

[54] FUEL BURNING APPLIANCE INCORPORATING CATALYTIC COMBUSTOR

[76] Inventor: Edward J. Horkey, 835 W. 22nd St., Suite C, Tempe, Ariz. 85282

[21] Appl. No.: 159,881

[22] Filed: Feb. 24, 1988

Related U.S. Application Data

[63] Continuation-in-part of Ser. No. 60,626, Jun. 11, 1987, abandoned.

[51] Int. Cl.[4] ..... F24B 1/02

[52] U.S. Cl. ..... 126/58; 126/77; 110/211; 110/214

[58] Field of Search ..... 126/58, 77, 289; 110/214, 210, 211

[56] References Cited

U.S. PATENT DOCUMENTS

| | | | |
|---|---|---|---|
| 1,280,235 | 10/1918 | Kermode | 126/58 |
| 4,319,556 | 3/1982 | Schwartz et al. | 126/163 R |
| 4,336,836 | 6/1982 | Horkey | 165/47 |
| 4,373,507 | 2/1983 | Schwartz | 126/289 |
| 4,437,451 | 3/1984 | Wysong | 110/203 |
| 4,466,421 | 8/1984 | Dorsch | 126/285 |
| 4,479,921 | 10/1984 | Allaire et al. | 422/180 |
| 4,549,524 | 10/1985 | Albertsen | 126/289 |
| 4,550,668 | 11/1985 | Piontkowski | 110/240 |
| 4,582,045 | 4/1986 | Doreau et al. | 126/290 |
| 4,690,126 | 9/1987 | Jencks et al. | 126/77 |

*Primary Examiner*—Martin P. Schwadron
*Assistant Examiner*—Allen J. Flanigan
*Attorney, Agent, or Firm*—Warren F. B. Lindsley

[57] ABSTRACT

A wood burning air augmented stove for reclaiming heat from the discharge gases employing a plurality of spaced catalytic combustors, one combustor being detachably mounted on the edge of a smoke baffle, and another combustor being positioned in a portion of the chimney flue which may be selectively moved from a gas intercepting position to a gas bypassing position. The catalytic combustors are so arranged that if one combustor is overheated, the second combustor will provide the additional gas heating and cleansing function needed. These combustors act in series to magnify temperature and heat increases.

7 Claims, 4 Drawing Sheets

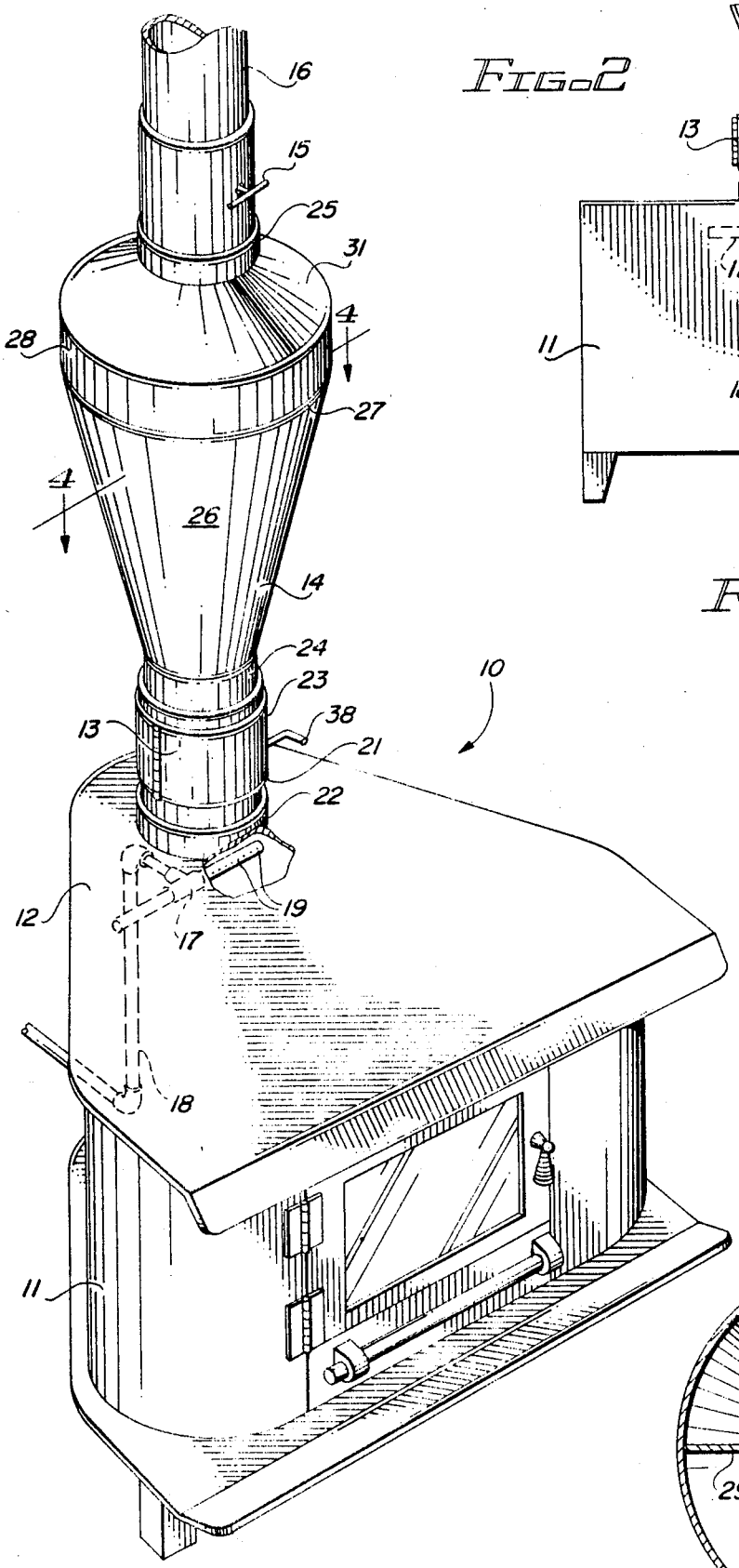
FIG. 1
FIG. 2
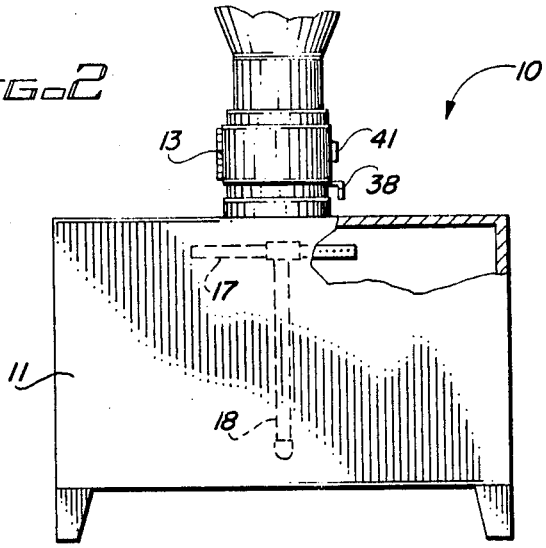
FIG. 3
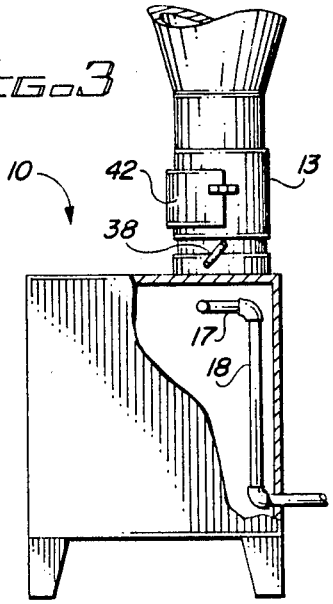
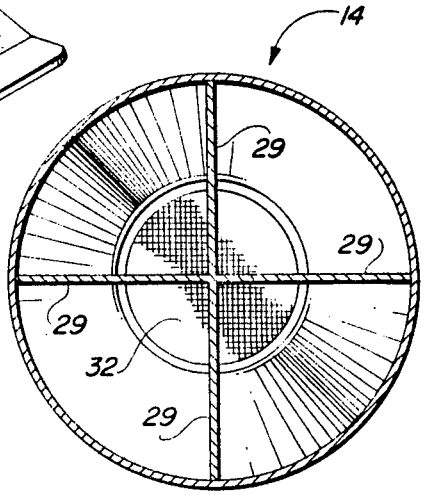
FIG. 4

FUEL BURNING APPLIANCE INCORPORATING CATALYTIC COMBUSTOR

BACKGROUND OF THE INVENTION

This application is a continuation-in-part of U.S. patent application Ser. No. 60,626 filed June 11, 1987 and entitled FUEL BURNING APPLIANCE INCORPORATING CATALYTIC COMBUSTOR, now abandoned.

This invention relates to wood burning stoves and heaters and improvements therein which maximize heating efficiency while reducing pollutants in the exhaust gases.

In recent years, due primarily to the energy crisis, wood burning stoves have enjoyed an ever-increasing popularity and public acceptance. The ultimate objective in stoves of this type is to achieve as complete combustion as possible of the combustion gases, since with more efficient combustion, burn time can be increased because it is possible to slow the fire down and still obtain the desired heat transfer for maximum comfort. However, most existing stoves of this type, i.e., airtight wood burning stoves, have a combustion efficiency somewhere in the range of fifty to sixty percent, primarily due to the fact that the ignition point of combustion gases is in the general range of 1300° F., whereas the temperatures generated in stoves of this type are usually in the range of 500° and 900° F. Thus, efficient combustion of these combustion gases has been difficult, if not impossible, to achieve, resulting in lower combustion efficiency, which in turn results in creosote buildup in the chimney or flue, which buildup frequently results in chimney fires. Also, reduced combustion efficiency results in undesirable smoke pollution.

Various arrangements have been employed in the prior art in which catalytic converters or combustors have been employed to oxidize flue gases and recover the additional heat associated therewith prior to discharge from the chimney. Specifically, by causing the combustion gases to flow through a catalytic combustor before reaching the exhaust duct or flue of the stove, the ignition point of the escaping combustion gases is lowered to the general range of 350°–500° F., thus resulting in almost complete afterburn of these gases in the normal range of operating temperatures in stoves of this type. This results in combustion efficiency in the general range of ninety percent, or in other words, an efficiency of approximately thirty-five percent more than that achieved by traditional woodburning stoves. This increased efficiency means little or no pollution will enter the atmosphere because the smoke, a normal byproduct of conventional wood stoves is actually chemically burned, leaving a harmless vapor and a small ash in its place. In addition, as a result of the almost perfect combustion that takes place, there is virtually no creosote buildup in the chimney, thus greatly reducing chimney fire hazards and at the same time, reducing chimney maintenance. Furthermore, peak performance can be obtained even with the use of soft and unseasoned wood and burn time can be increased because it is possible to slow the fire down and still maintain almost perfect combustion while transferring heat temperatures necessary for maximum comfort.

While the use of such catalytic combustor units has proved useful in eliminating substantial quantities of creosote and in increasing the efficiency of the wood burning stove, there have previously been a number of limitations in the use of such catalytic combustors. For example, such catalytic combustor units over a period of operation become sites for the deposits of carbon ash residue and creosote residue. The carbon ash residue may be deposited on the combustor in such a manner that the combustor element is clogged and eventually becomes inoperative. The creosote residue may also clog the catalytic combustor over a period of time and prevent or interfere with proper functioning of the combustor unit.

Another problem associated with the incorporation of the catalytic combustor in a stove or heater is that while the combustor functions well in the intended manner once the fire is established, its presence in the airflow path is not always advantageous. During the starting of the fire, before the heated flue gases have developed a strong updraft, the combustor impedes airflow and interferes with starting. Also, when the door of the stove is opened to add fuel or to attend to the fire bed, the air restriction caused by the combustor sometimes causes smoke and gases to be exhausted into the room.

The successful implementation of a stove or heater incorporating a catalytic combustor is, therefore, dependent upon the realization of satisfactory solutions to a number of problems that have not been simultaneously addressed or effectively resolved in the prior art.

PRIOR ART

Various devices have been developed to reclaim heat from the exhaust pipe of a fuel burning appliance (stove, heater, etc.). While these devices do operate to reclaim additional heat, a common problem is encountered where the structure of the device upsets the draft required to maintain combustion. The result is that both back puffing of smoke and difficulty in developing a proper rate of combustion may ensue. Those devices which have addressed the problem of maintaining an adequate draft throughout the burning cycle have resulted in unduly complex mechanisms.

U.S. Pat. No. 1,280,235 discloses a heating stove comprising a preheater and first and second combustion chambers. Inlet air is preheated before entering the first combustion chamber in which the primary fuel is burned. Air and combustion products pass from the first combustion chamber to the second combustion chamber into which additional atmospheric air is admitted to promote further combustion of gases and soot prior to discharge into the stove pipe.

U.S. Pat. No. 4,336,836 discloses an apparatus mounted in the flue of a combustion fuel heating unit for reclaiming heat from the discharge gases, which reclaimer exposes the discharge gas flow to an increased surface area of the flue to absorb a portion of the heat energy otherwise lost in the exhaust gas flow.

U.S. Pat. No. 4,373,507 discloses a wood burning stove that employs a catalytic converter to achieve increased combustion efficiency. A manually controlled damper causes the converter to be bypassed before the door of the stove can be opened.

U.S. Pat. No. 4,466,421 discloses an afterburner intended for installation in the flue of an existing stove. The afterburner incorporates a catalytic combustor which may be moved forward manually to remove it from the path of the flue gases.

U.S. Pat. No. 4,549,524 discloses an apparatus for supporting a catalytic converter as a means for burning exhaust gases from a heating stove. The apparatus incorporates a means for bypassing the converter when necessary, as during the starting of the fire in the primary combustion chamber.

U.S. Pat. No. 4,550,668 discloses a combustor unit for a wood burning stove. The unit comprises a T-shaped flue assembly incorporating a catalytic converter that can be tilted out of the way of the exhaust gas stream into an access passageway through which it is removable and in which it may be cleaned without removal.

Each of the above described prior art devices or apparatus addresses one or the other of the various problems associated with the attainment of increased heating effectiveness or efficiency or with the removal of pollutants from the flue gases. What is needed, however, is an improved stove or heater that incorporates catalytic combustors in a manner that results in optimum automatic operation under all conditions with the necessary controls and access conveniently and inexpensively provided.

The present invention is directed toward the provision of an improved heater or stove in which the total arrangement of the stove is optimized for the simultaneous solution of all the problems that have been related.

SUMMARY OF THE INVENTION

In accordance with the invention claimed, a new and improved fuel burning appliance is provided in which the total configuration of the appliance is optimized for the achievement of maximum heating efficiency and pollutant removal. Pollutant removal is achieved through the incorporation of a catalytic combustor in a manner that does not interfere with other aspects of operation.

It is, therefore, one object of the present invention to provide an improved fuel burning appliance.

Another object of this invention is to provide as an element of such an appliance an improved heat reclaimer and catalytic combustor which substantially increases oxidation or burning of carbon monoxide and other fuel volatiles at temperatures that otherwise would not allow oxidation to occur.

A further object of this invention is to incorporate in such an appliance an improved heat reclaimer and catalytic combustor that substantially reduces creosote and air pollutants in the exhaust gases of a wood burning appliance.

A still further object of this invention is to incorporate such a heat reclaimer and catalytic combustor in such an appliance in a manner which permits the maintenance of the necessary draft to fire the appliance for the burning of wood or other fuels.

A still further object of this invention is to incorporate in such an appliance a holder for the catalytic combustor that is simple in form, inexpensive in construction and fully functional in the sense that it allows for rotation of the combustor to a bypass position and convenient cleaning in the bypass position or removal for cleaning.

A still further object of this invention is to incorporate in such an improved burning appliance a heat reclaimer for extraction of the heat of combustion produced in the catalytic combustor.

A still further object of this invention is to provide an improved fuel burning appliance employing at least a pair of catalytic combustors spaced from each other in the path of movement of the combustion gases to reduce pollutants in the exhaust gases.

A still further object of this invention is to provide an improved fuel burning appliance employing at least a pair of catalytic combustors spacedly positioned in the path of movement of the combustion gases, the second one of which functions to oxidize flue gases and recover additional heat associated therewith if the first catalytic combustor is overloaded, thereby failing to completely oxidize and burn all of the combustion gases passing therethrough. The use of two combustors creates automatic flow features with no manual controls required.

A still further object of this invention is to provide two combustors in series with temperature or heat magnification.

A still further object of this invention is to provide a plurality of spaced catalytic combustors in a fuel burning appliance, with one combustor mounted on an edge of a smoke baffle mounted above the fire bed.

A still further object of this invention is to provide in such an improved burning appliance means for augmenting the air supply, thereby offsetting any restriction of airflow resulting from the incorporation of the catalytic combustor.

A still further object of this invention is to provide a triangular-shaped burning appliance that enhances heat radiation at the front of the appliance. A triangular configuration is markedly better than a trapezoidal shape used on some stoves.

A still further object of this invention is to provide such an improved fuel burning appliance in an inexpensive form that is equally adaptable to stoves or fireplaces.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which:

FIG. 1 is a perspective view of one embodiment of the improved fuel burning appliance or stove of the invention;

FIG. 2 is a front view of the lower portion of the appliance of FIG. 1 with portions of the firebox cut away to show the form and placement of an air augmentation means incorporated in the appliance;

FIG. 3 is a side view of the lower portion of the appliance of FIG. 1, again with portions of the firebox cut away to show the air augmentation means;

FIG. 4 is a cross-sectional view of FIG. 1 taken along the line 4—4;

DESCRIPTION OF THE PREFERRED EMBODIMENT

Figure 5:
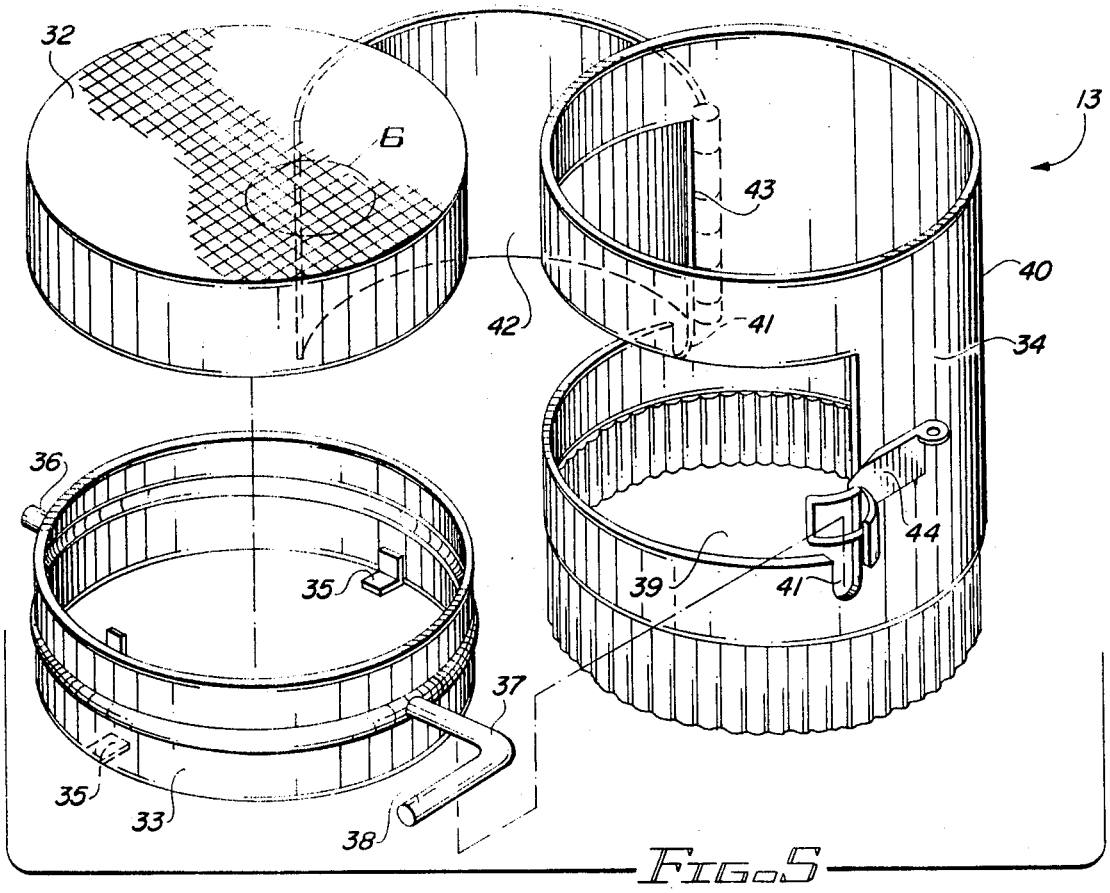
FIG. 5 is an exploded perspective view of the catalytic combustor and its associated combustor holder.

Referring more particularly to the drawings by characters of reference, FIGS. 1-3 disclose a fuel burning appliance or stove 10 comprising a firebox 11, an air augmenter 12, a catalytic combustor 13, a heat exchanger 14, a damper 15 and a flue or chimney 16.

While appliance 10 is not limited to use for burning wood, the immediate object of the invention is to provide a stove that is ideally suited, first of all, for use as a wood burning stove.

Firebox 11 is a relatively conventional heater or stove, ordinarily made of iron or steel, except that its general shape or configuration as viewed from above is preferably triangular rather than rectangular. The triangular shape is advantageous for a number of reasons. As shown in FIG. 1, one side of the triangular configuration constitutes the front of the firebox while the flue is positioned over the opposite corner at the rear of the firebox. The firebox thus has its widest dimension at the front, and it can thus accommodate a wide grate and relatively long pieces of firewood at the front where the fuel is normally loaded. A second advantage of the triangular configuration is that the wall of the firebox that faces to the front constitutes approximately one-third of the total vertical radiating surface of the firebox as compared with one-fourth of the total for the front face of a square or slightly rectangular firebox. The triangular configuration also allows for a wider door, improved air entry from the front and a good internal airflow pattern. When a cooking surface is to be provided on top of the firebox, the enlarged forward dimension provides increased cooking space at the front of the stove. In addition, if a fan is positioned behind the stove, the air from the fan will be split by the rearward apex and will flow past both sides of the firebox to distribute heat effectively throughout the room being heated.

Air augmenter 12 comprises a hollow pipe structure including a horizontal pipe member 17 supported by a vertical pipe member 18. Horizontal pipe member 17 is perforated along its sides to prevent plugging by foreign material. Air introduced into member 18 from out-of-doors flows into and out of member 17 via perforations 19. Due to its position below catalytic combustor 13, heated air supplied by augmenter 12 to combustor 13 enhances its performance.

As shown in the drawings, the catalytic combustor 13 is connected at its inlet end 21 to one section of a flue 22 leading from firebox 11 and at its outlet end 23 to the inlet 24 of an expansion section of heat exchanger 14. The outlet section 25 of heat exchanger 14 is connected to the flue or chimney 16 for exhausting combustion gases of stove 10 to atmosphere.

The expansion section 26 of the heat exchanger 14 has a circumference which gradually increases in the direction of gas flow. It is connected at its inlet 24 to the outlet 23 of combustor 13 and at its expanded end 27 to an idler section 28 of exchanger 14. The expansion section 26 encloses flow splitter plates 29 which are radially arranged about the axis of expansion section 26, as shown in the cross-sectional view of FIG. 4. A reduction section 31 of exchanger 14 is connected to idler section 28 and to outlet section 25 which in turn is connected to one section of the flue or chimney 16.

Figure 6:
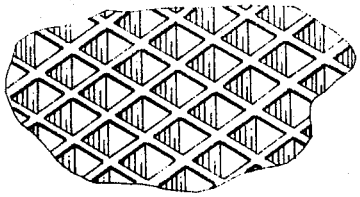
FIG. 6 is an enlarged perspective view showing details of the combustor construction as seen at area 6 of FIG. 5.

The catalytic combustor 13 comprises a catalytic element 32 shown in FIGS. 5 and 6 which, when inserted properly into a fuel burning stove or heater, will "burn" the smoke, carbon monoxide and particulates which are not burned by the fire in firebox 11 or combustor 13A. It is an "after burner" which, because of a catalyst, chemically breaks down smoke, carbon monoxide and particulates into substances that are burned at a low temperature. The combustor element 32 is in the form of a short cylinder or disc having a honeycomb structure with axial openings through which the flue gases are passed. The relatively large surface area produced by the honeycomb structure enhances the operating efficiency of the combustor.

Catalytic combustors can be made of ceramic or metal and may use different kinds of catalysts which are applied to the ceramic or metal by different methods and in different quantities and they are manufactured in various shapes and sizes.

The size and shape of the catalytic combustor for a given heater is determined by the size of the firebox and the space available for its installation. Use of a plurality of combustors increases the total combustion surface available.

The most substantial difference, however, is the "substrate" material (the material on which the catalyst is applied). Two basic substrates are used, namely metal or ceramics.

Metal is generally not an acceptable substrate for catalysts due to two reasons:

a. The expansion of the metal substrate is different than the expansion of the catalyst. Therefore, as the combustor reaches the very high temperatures it is subjected to, the metal substrate begins to expand—the catalyst metals are expanding at a different rate—and the catalyst may fall off.

b. Metal is not porous enough to sustain enough catalyst to perform. In other words, enough catalyst may not stick to the metal to enable sufficient catalytic activity.

The best catalyst substrate material is ceramic. Most ceramic substrates are made from cordierite which is a high temperature resistant ceramic which does not have sufficient thermal shock resistance to withstand the wood stove environment. After a period of use, ranging anywhere from one month to one year, cordierite combustors may begin to crack and break or begin crumbling to the point where large sections of the combustor are gone. Technical Glass Products of Kirkland, Washington, manufactures and sells a honeycomb type ceramic which is a combination of calcium aluminate and titanium oxide. The combination of these two ceramics make a substrate with a high surface area, high temperature resistance and excellent thermal shock resistance. It works better, and lasts longer than the prior art.

The basic catalysts used for wood smoke are platinum and palladium, although other more rare metals may be used. With most combustors, the grams of platinum and/or palladium are applied to the ceramic or metal substrate with a "washcoat". In other words, the ceramic or metal substrate is dipped into a liquid which clings to the substrate and the catalyst is applied to the washcoat. The washcoat sticks to the ceramic, and the catalyst sticks to the washcoat. While this method works well in the beginning, as the catalytic combustor is used at high temperatures, the washcoat may begin to "spall" or pull away from the ceramic and fall off, taking the catalyst with it. Eventually, all you may have is a ceramic substrate with no catalyst. The Technical Glass product which is covered by U.S. Pat. No. 4,350,613 is "impregnated" into the ceramic—actually placed in the ceramic material as it is formed. The benefits of this are obvious—you always maintain the catalyst—it does not fall off. The description of U.S. Pat. No. 4,350,613 is incorporated herein by reference.

It is important to remember when operating a catalytic combustor equipped device, to make sure you have achieved catalytic "light-off" before you place the unit into the catalytic operational mode. Light-off simply means that you have achieved enough temperature within your unit to start the catalytic combustor operating. Catalytic burning, like all types of burning, requires three essential elements: fuel, oxygen and temperature. The "smoke" is the fuel. The catalytic element disclosed is designed so that it will have sufficient oxygen, but the operator must assure that the required temperature is achieved. The temperature needed to begin catalytic activity is generally 350°-500° F. This is a temperature that is easily achieved when you build a fresh fire, or when you reload your existing fire. The use of a magnetic thermometer, a probe thermometer, or various digital readouts available on the market today will be of help in determining if the necessary temperature is achieved.

The heater may be equipped with a bypass mechanism, which permits the operator to "bypass" the smoke around the combustor when the necessary 350°-500° F. to start catalytic activity is not achieved, or when the operator is reloading the stove.

The proper use of the bypass mechanism and temperature gauge are the two most important things to learn when operating a catalytic combustor equipped device and if used properly will eliminate a large portion of combustor problems.

Another important thing to remember when operating a catalytic combustor equipped device (or any wood burning device) is to burn seasoned, dry wood only.

The gas discharge from a wood burning stove or heater, such as firebox 11, comprises carbon monoxide (CO), hydrocarbons (HC), i.e., smoke, and unburned or used oxygen. With a catalytic combustor containing a rare metal coating operating in a gas temperature atmosphere of 350°-500° F., the rare metal coating of the combustor agitates the molecules in the combustor for a further burning action of the discharge gases (smoke) of the heater.

The catalytic combustion action results in a burning action that creates a flue discharge of carbon dioxide and water containing a low creosote and air pollutant content. The exhaust gases are approximately 1400°-1700° F.

TEST PERFORMANCE

Tests were conducted on a 6" diameter heat reclaimer and catalytic combustor at Omni Environmental Services of Beaverton, Oreg. Results for a run of one heat output test showed marked improvement over a simple stove with a plain cylindrical chimney connector. Equivalent or higher performance than a multi-chambered stove with a catalytic combustor and plain cylindrical chimney connector occurred.

Specific data obtained:

Heat Output: 17,387 BTU/Hr.
Combustion Efficiency: 89.9%
Heat Transfer Efficiency: 85.4%
Overall Efficiency: 76.7%
CO: 0.43%
Particulates: 3.49 Grans/Hr.

Figure 7:
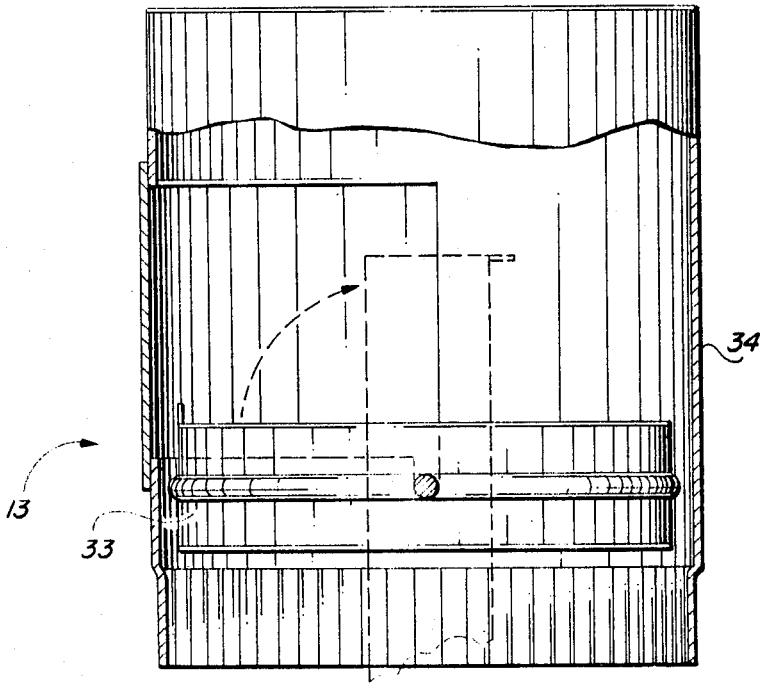
FIG. 7 is an enlarged partially cut away view of the assembled combustor holder of FIG. 5.

Combustor 13, as shown in FIGS. 5 and 7, comprises, in addition to catalytic element 32, a rotatable cradle 33 and a housing 34.

Cradle 33 has the general form of a short cylindrical band with inwardly extending tabs 35 at its lower edge. Its inside diameter is just larger than the outside diameter of the disc-shaped catalytic element 32, so that when element 32 is dropped into cradle 33 from above the lower periphery of element 32, it rests upon tabs 35. A first support rod 36 extends radially from one side of cradle 33 and a second support rod 37 extends radially from the opposite side of cradle 33, 180° removed from first support rod 36. Rod 37 has a ninety degree bend at its outer end, the bend forming a handle 38 which is employed to rotate cradle 33 and with it element 32.

Housing 34 of combustor 13 comprises a short vertically mounted section of flue pipe 40 into which is cut a horizontal slot 39, the slot extending 180° about the pipe, and its height being somewhat greater than the height of cradle 33. A slot 41 is cut into each of the two lower corners of slot 39. A cover 42 having a shape and dimensions approximating but slightly greater than those of the section of pipe removed to form slot 39 is hinged at one vertical edge 43 of slot 39 and is secured in a closed position by a latch or hasp 44 at the opposite vertical edge of slot 39.

Combustor 13 is assembled by first placing element 32 inside cradle 33. Cradle 33 is then passed through slot 39 into housing 34, and is dropped into place with rods 36 and 37 supported within slots 41. Door 42 is then closed and secured by means of hasp 44. The outside diameter of cradle 33 is just sufficiently smaller than the inside diameter of housing 34 as to permit cradle 33 to be rotated about rods 36 and 37 within housing 34. Handle 38 is employed to rotate cradle 33 to the desired position which is horizontal when the combustor is to be operative and vertical when the catalytic element 32 is to be bypassed.

It will be noted that the constructions of housing 34 and cradle 33 readily accommodate the removal of cradle 33 and element 32 (for the cleaning or replacement of element 32) from the fully assembled appliance 10 without requiring the removal of a single pipe section of flue 16 or of any other associated hardware.

Augmenter 12 is a series of pipes and fittings which supply heated fresh air to the bottom side of the combustor through the top pipe which has a series of small holes.

Damper 15 is a conventional butterfly-type damper installed in flue 16 in the usual manner directly above heat exchanger 14, to obtain extended burning of fumes.

OPERATION

The operation of the subject invention occurs as follows:

Combustion occurring in heater 12 produces a natural convection flow beginning with the fresh air supply to the firebox and proceeding from firebox 11 upward through combustor 13 and heat exchanger 14 past damper 15, through flue 16 and out the chimney to the atmosphere.

The inlet air feeds the fire in firebox 11 supplying oxygen needed for combustion of the fuel which in the preferred embodiment may be firewood. Because the oxidation of the fuel is never complete, even under ideal conditions, combustion products in the firebox contain carbon monoxide, soot, creosote and other pollutants.

Because the oxygen content of the inlet air to firebox 11 has been severely depleted by the burning fuel, the oxygen content of the combustion products is undesirably low. This deficiency of oxygen is corrected by fresh hot air supplied by augmenter 12, the fresh supply of air mixing with the combustion products just prior to their entry into catalytic combustor 13.

Catalytic action within combustor 13, enhanced by the fresh air supply from augmenter 12 causes the pollutants to be oxidized, and the oxidation process releases additional heat, elevating the temperature of the exhaust gases which pass upward into heat exchanger 14.

The expanding circumference of expansion section 26 provides increased surface area for the radiation of heat into the living area, thereby increasing the amount of heat transferred.

To prevent separation of flow from the tapered wall of expansion section 26, the slope of the wall must be limited to less than 0.1228 with respect to the vertical axis of exchanger 14. Utilization of a greater slope, or rate of change of the circumference, for the wall of the expansion section will produce a separation of the flow from the wall of the expansion section with deleterious effects upon both the drafting function and the heat transfer rate.

Separation of the flow from the wall of the expansion section is further discouraged by the flow splitter plates 29 inside expansion section 26. The connected flow splitter plates, which are arranged radially about the axis of the expansion section, function with the wall of the expansion section to form separately diverging flow compartments. Each wall of each flow compartment may be arranged with a limiting slope of 0.1228 with respect to the centroidal axis of that flow compartment. For a frusto-conical-shaped expansion section enclosing a single tier of radially arranged flow splitter plates, the slope of the wall of the expansion section with respect to the axis of the heat exchanger 14 may be increased to a limiting value of 0.2493, thereby increasing further the overall area for heat transfer, while avoiding a disruption of the drafting function.

The idler section provides additional heat transfer area for the fully expanded flow. The reduction section 24 whose circumference gradually decreases in the direction of flow, converges the flow to enter the outlet section 18. The flow passes from the reduction section 24 through flue section 23 and into the exhaust pipe or chimney.

To render the catalytic converter element 32 inoperative, and to realize a maximum draft condition during the starting of a fire, the cradle 33 together with element 32 are rotated ninety degrees to a vertical position using handle 38.

FIGS. 9 through 15 disclose a further modification of the fuel burning appliance or stove 10 disclosed in FIGS. 1 through 8, wherein like parts of stove 45 are given the same reference characters as those used in FIGS. 1 through 8.

Figures 8, 10, 12, 13:
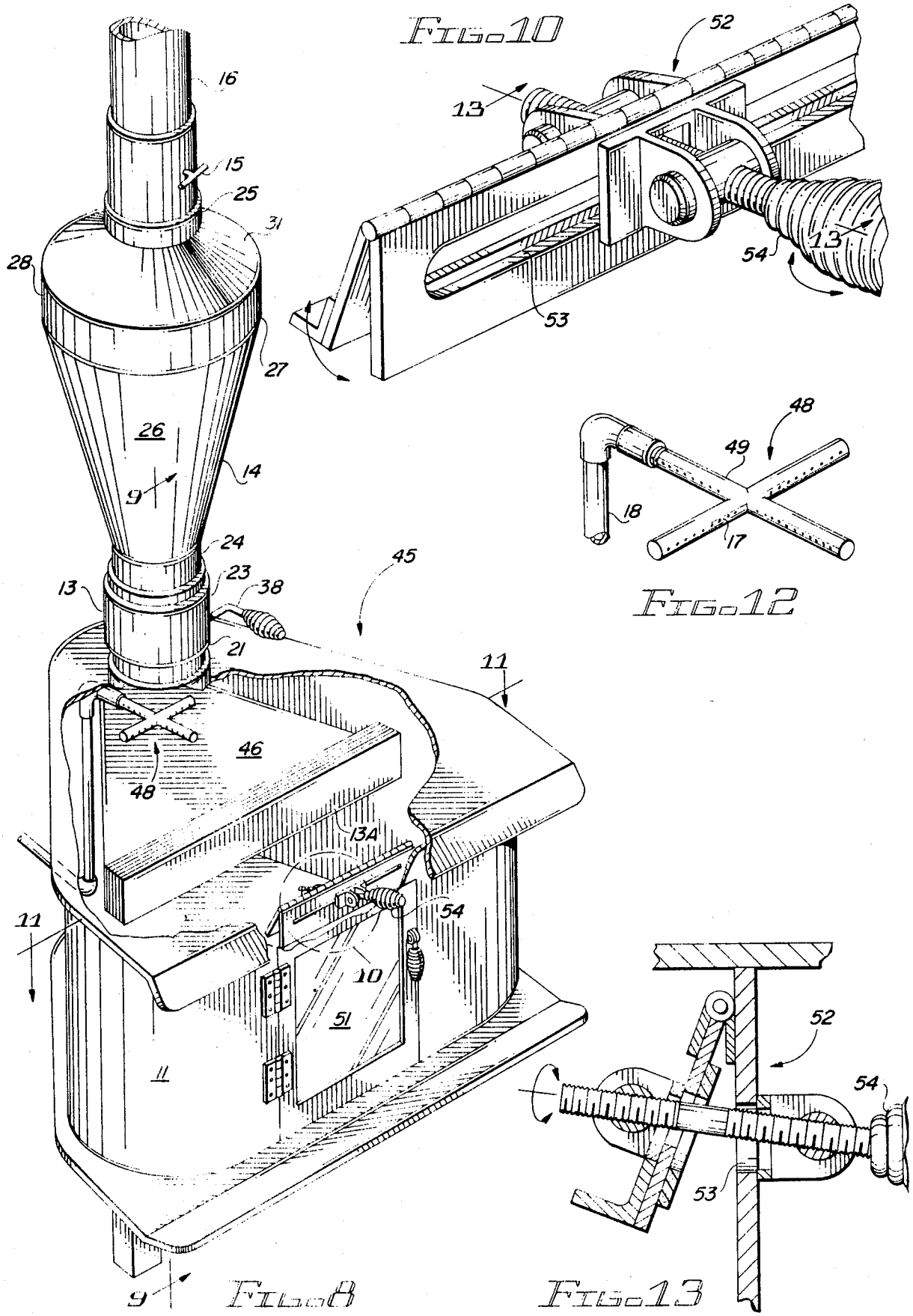
FIG. 8 is a perspective view of a further embodiment of the fuel burning appliance or stove shown in FIG. 1, employing a pair of catalytic combustors spaced from each other in the path of movement of the combustion gases and an air vent above the door of the stove for controlled air movement in the stove.
FIG. 10 is an enlarged view of the circled area identified by the reference character 10 in FIG. 8.
FIG. 12 is an enlarged perspective view of the air supplement manifold shown in FIG. 8.
FIG. 13 is a cross-sectional view of FIG. 10 taken along the line 13—13.
Figure 9:
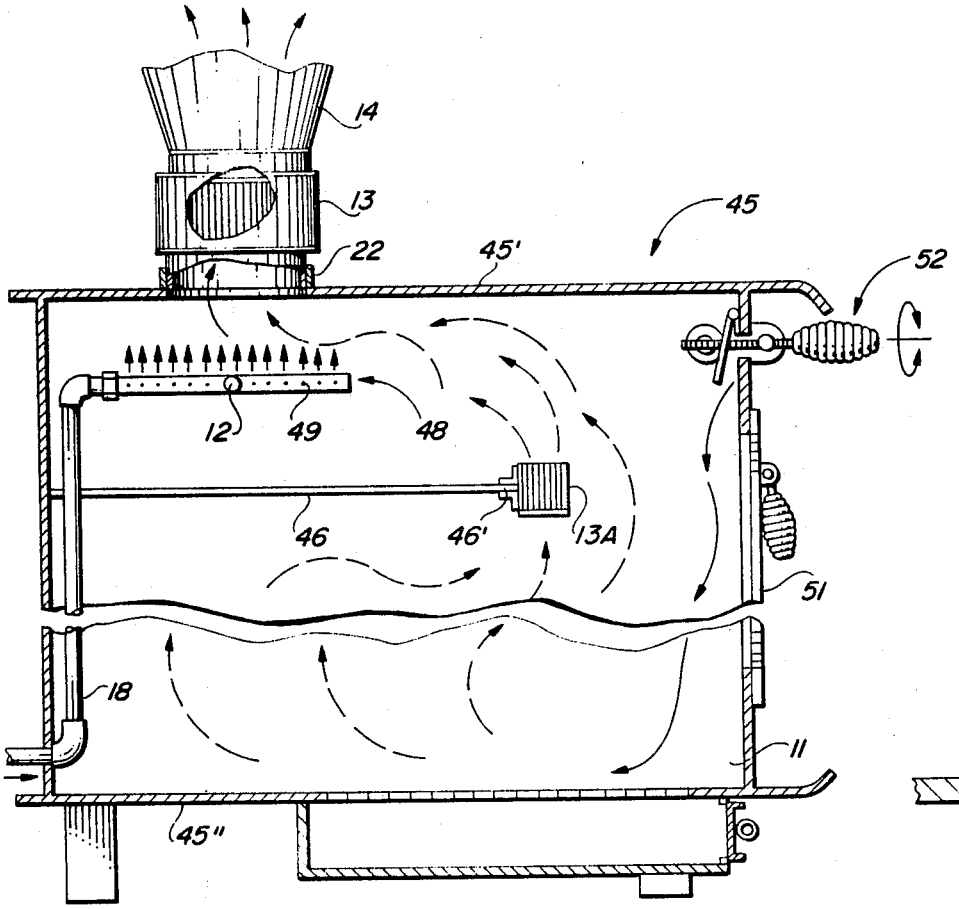
FIG. 9 is a cross-sectional view of FIG. 8 taken along the line 9—9.
Figure 14:
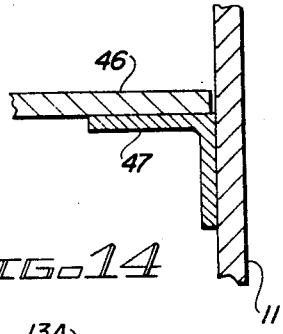
FIG. 14 is a cross-sectional view of FIG. 11 taken along the line 14—14.
Figure 11:
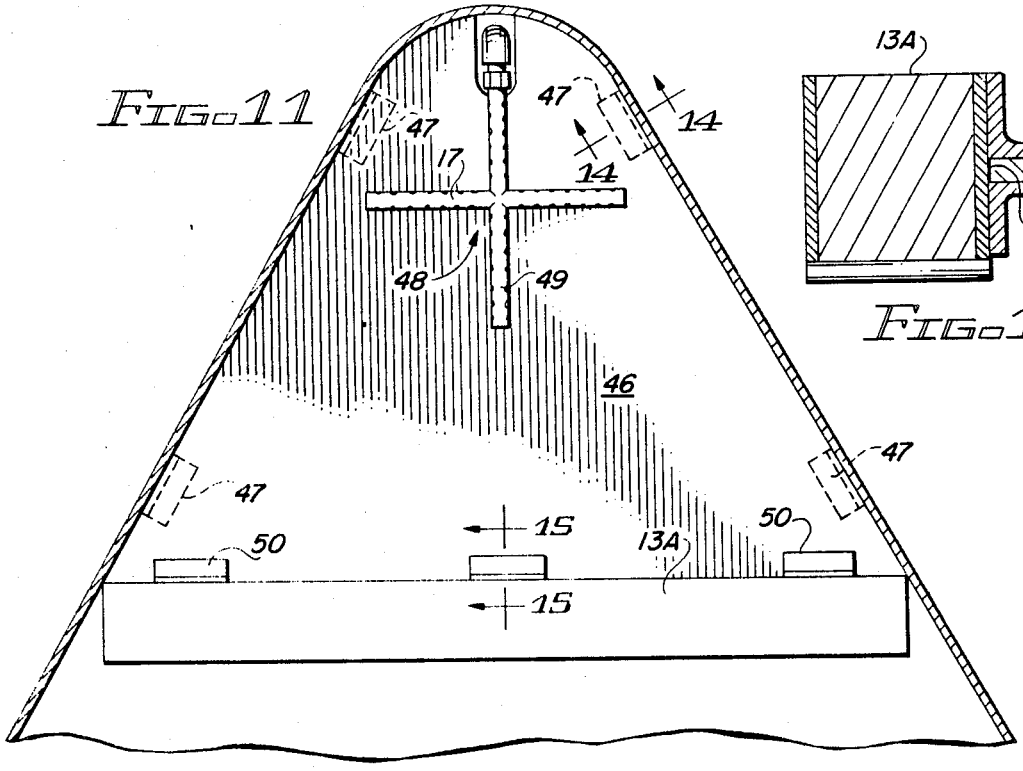
FIG. 11 is a cross-sectional view of FIG. 8 taken along the line 11—11.
Figure 15:
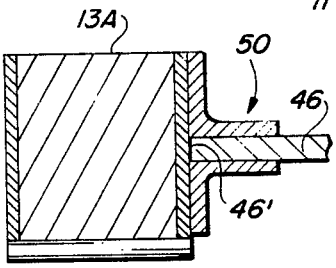
FIG. 15 is a cross-sectional view of FIG. 11 taken along the line 15—15.

As noted from FIGS. 8, 9 and 10, stove 45 is provided with a smoke baffle 46 which is mounted horizontally substantially midway between the top 45' and bottom 45" of the firebox 11 of stove 45. The baffle rests on a plurality of right-angle clamps 47 secured to the inside walls of the firebox, as shown in FIGS. 11 and 14.

FIG. 9 illustrates that the modified air augmenter 48 differs from the structure 17, 18 and 19, shown in FIG. 1, by the addition of the perforated pipe 49 which distributes the added air more uniformly than the structure shown in FIG. 1. As noted, the air augmenter 48 is mounted between the top of smoke baffle 46 and the entranceway into flue 22.

In accordance with the invention claimed, a second catalytic combustor 13A is detachably mounted on the edge of smoke baffle 46. This combustor may be in the form of a rectangular box having a catalytic element 32 of the type shown in FIGS. 5 and 6, and described with regard thereto which, when clamped to the free edge 46' of baffle 46, will "burn" the smoke, carbon monoxide and particulates which are not burned by the fire in firebox 11.

As noted from FIG. 9, the smoke, carbon monoxide and particulates of the burning fire driven through the catalytic combustor 13A are burned in combustor 13A with any excess from the firebox by passing combustor 13A being driven into catalytic combustor 13. This excess by-product of the firebox together with the exhaust gases from catalytic combustor 13A are further burned in combustor 13.

Thus, a two-step process is disclosed together with structure for accomplishing the sequential burning in a pair of catalytic combustors, the by-products of the firebox of a stove. The action is a natural flow process requiring no manual controls.

The dual catalytic combustor function eliminates overloading of either of the combustors and substantially eliminates the possibility of exhausting into the atmosphere smoke, carbon monoxide and harmful particulates of the burned fuel gases.

Since the catalytic combustor 13A is provided with a plurality of clamp means 50 which slidably receive therebetween the edge 46' of baffle 46, the combustor may be readily removed from the stove 45 through its door 51 for cleaning and repair purposes.

As shown in FIGS. 8, 9, 10 and 13, an adjustable damper 52 is provided in the walls of the stove above door 51 which may open and close a passageway 53 formed therein for controlling atmospheric air into the firebox of the stove. This air passes downwardly over door 51 to the base of the firebox to keep the glass of the door clean and aids the fuel combustion and then passes through combustors 13A and 13 into flue 22.

This damper is controlled by rotation of its handle 54 to open and close its passageway 53 into the firebox.

An effective fuel burning appliance incorporating a catalytic combustor together with convenient means for the control and maintenance of the catalytic element is thus provided in accordance with the stated objects of the invention.

Although but a few embodiments of the invention have been shown and claimed, it will be apparent to those skilled in the art that various changes and modifications may be made therein without departing from the spirit of the invention or from the scope of the appended claims.

What is claimed is:

1. An apparatus for reclaiming heat and removing pollutants from the discharge gases of a fuel burning appliance, the apparatus comprising:

a firebox having a combustion chamber for receiving and burning fuel and a flue for discharging burned fuel gases, a catalytic combustor means, said combustor means comprising a pair of individual catalytic combustors each having an inlet and an outlet, said combustors being spacedly arranged in said apparatus for sequentially receiving one from the other in the burned fuel gases of said firebox, one of said combustors being positioned in said firebox for directly receiving at least a part of the discharge gases from said firebox, burning said discharge gases and discharging through its outlet a first burned discharge gas into the inlet of the other of said combustors, said other of said combustors being positioned in said flue for further burning said first burned discharge gas and discharging through its outlet a second burned discharge gas comprising the residue of said burned fuel gases, a smoke baffle mounted within said firebox for deflecting the flow of said burned fuel gases, said one of said combustors being detachably affixed to said baffle, and said other of said combustors being mounted in said flue adjacent said outlet of said chamber, whereby said other of said combustors operates at a temperature elevated from the operating temperature of said one of said combustors to provide the benefits of temperature magnification.

2. The apparatus set forth in claim 1 wherein:

said other of said combustors comprises a hollow cylindrical housing position within said flue, a cradle rotatably mounted in said housing for selectively supporting said other of said combustors in said housing in a first position for intercepting said one burned discharge gas and a second position for bypassing said one burned discharge gas in their passage through said housing.

3. The apparatus as set forth in claim 2 in further combination with:

a door formed in said housing for exposing, when opened, said cradle and being of sufficient size for the removal of said cradle and the other of said combustors for cleaning and replacement purposes.

4. The apparatus as set forth in claim 1 wherein:

said baffle comprises a flat plate mounted substantially horizontally in said firebox and having an exposed edge, and said one of said combustors being detachably connected to said edge.

5. The apparatus set forth in claim 2 wherein:

said apparatus is provided with a door juxtapositioned to said exposed edge of said baffle for removing said one of said combustors from said chamber for servicing.

6. The apparatus set forth in claim 2 wherein:

said combustion chamber is of triangular configuration.

7. The apparatus set forth in claim 2 wherein:

said one of said combustors comprises an elongated rectangular box-shaped honeycomb structure detachably mounted to extend along side edge of said baffle, and said other of said combustors comprises a disc-shaped honeycomb structure.

* * * * *

UNITED STATES PATENT OFFICE

CERTIFICATE OF CORRECTION

Patent No. 4,844,051 Dated July 4, 1989

Inventor(s) Edward J. Horkey

It is certified that error appears in the above-identified patent and that said Letters Patent is hereby corrected as shown below:

Col. 11, Claim 1, line 22, after "other", delete "in".

Signed and Sealed this

Seventeenth Day of April, 1990

*Attest:*

HARRY F. MANBECK, JR.

*Attesting Officer*

*Commissioner of Patents and Trademarks*